US005169010A

United States Patent [19]

Fortner

[11] Patent Number: 5,169,010

[45] Date of Patent: Dec. 8, 1992

[54] SPACE SAVER DEVICE

[76] Inventor: Joseph B. Fortner, 8 Valley Brook Dr., Fairport, N.Y. 14450

[21] Appl. No.: 824,511

[22] Filed: Jan. 23, 1992

[51] Int. Cl.[5] ..... A47F 5/00

[52] U.S. Cl. ..... 211/86; 211/181

[58] Field of Search ..... 211/86, 106, 105.1, 211/88, 90, 181; 108/29, 30, 42

[56] References Cited

U.S. PATENT DOCUMENTS

| | | | |
|---|---|---|---|
| 2,612,273 | 9/1952 | Smith | 211/86 |
| 2,876,908 | 3/1959 | Magnum | 211/86 |
| 3,233,744 | 2/1966 | Ripps | 211/86 |
| 3,866,704 | 2/1975 | Bowers et al. . | |
| 4,181,382 | 1/1980 | Harvey | 312/245 |
| 4,233,911 | 11/1980 | Vignale | 108/30 |
| 4,261,957 | 4/1981 | Schimanski | 422/263 |
| 4,327,809 | 5/1982 | Fenstermaker . | |
| 4,372,449 | 2/1983 | Fink | 211/86 |
| 4,520,887 | 6/1985 | DiFazio . | |
| 4,799,432 | 1/1989 | Rickner | 211/105.1 |
| 4,817,401 | 4/1989 | Cohodar . | |
| 4,827,849 | 5/1989 | Vignale | 108/29 |
| 4,854,540 | 8/1989 | Balek . | |
| 4,870,907 | 10/1989 | McKee | 108/42 |

*Primary Examiner*—Alvin C. Chin-Shue
*Assistant Examiner*—Sarah A. Lechok
*Attorney, Agent, or Firm*—Cumpston & Shaw

[57] ABSTRACT

A space saving device which is adapted to be affixed between a towel bar and a support wall and which is in the form of a unitized body having a central vertical leg adapted to lay against a supporting vertical wall with the upper end of said leg supporting an upper storage basket and the lower end adapted to support a lower storage basket when said vertical leg is disposed against a flat surface. The lower or opposite end of said leg further contains a plurality of attachment means which are adapted to fit over a towel bar.

9 Claims, 1 Drawing Sheet

SPACE SAVER DEVICE

BACKGROUND OF THE INVENTION

The present invention is directed in general to a device for use in the tub or shower area of the home and more specifically to a space saving device for containing and storing miscellaneous bathroom items and toiletries.

It is common, because of the lack of space and cabinet facilities, that various items such as shampoo, razors, soap and the like are simply stacked or placed at random in bathrooms on window ledges, or any other flat surface such as the edge of a tub or the top of a toilet commode. The various storage problems commonly associated with bathrooms results in an unsightly cluttered look due to the lack of organization and/or limited space in many bathrooms.

There is, therefore, an existing need for a device or facility which can be easily adapted to existing bathroom fixtures to provide a convenient and economical means for storage.

It is an object of the present invention to provide a unique space saving device for use in the tub or shower area of the home that utilizes existing bathroom towel bar fixtures for its installation and support, and can be easily installed without the use of any tools.

SUMMARY OF THE INVENTION

The present invention is directed to a space saver device for use in the tub or shower area of the home. The device is unique in that it utilizes existing bathroom bar fixtures for its support and requires no tools or fasteners for installation. In one embodiment, the device is constructed of welded wire formed in such a manner as to provide at least two storage shelves or baskets (one upper basket and one lower basket) for containing miscellaneous bathroom items such as shampoo and conditioner bottles, combs, safety razors, soap and the like.

The device is in the form of a unitized body with the lower basket having an inside leg that contacts the towel bar fixture and is formed at an angle greater than 90 degrees with the floor of the lower basket. This features creates a cantilever spring which when loaded, by wedging the device between the towel bar and the wall, results in a component of force on the leg in contact with the wall and in the direction of the wall.

In operation, the device is installed by simply wedging it between the inside of the towel bar and the adjacent wall, and then snapping a plurality of wire towel hooks in place. This cantilever spring feature results in a component force on the leg in contact with the wall, and in the direction of the wall, and as a result of this preload feature, aids in supporting the items in the upper basket. As an added feature, a single wire with loops at each end spanning the width of the device is hooked over the bottom rung of one or both of the baskets to provide a towel or wash cloth bar, thus not sacrificing the usefulness of the fixture to which the device is attached.

DETAILED DESCRIPTION OF THE INVENTION

Figure 1:
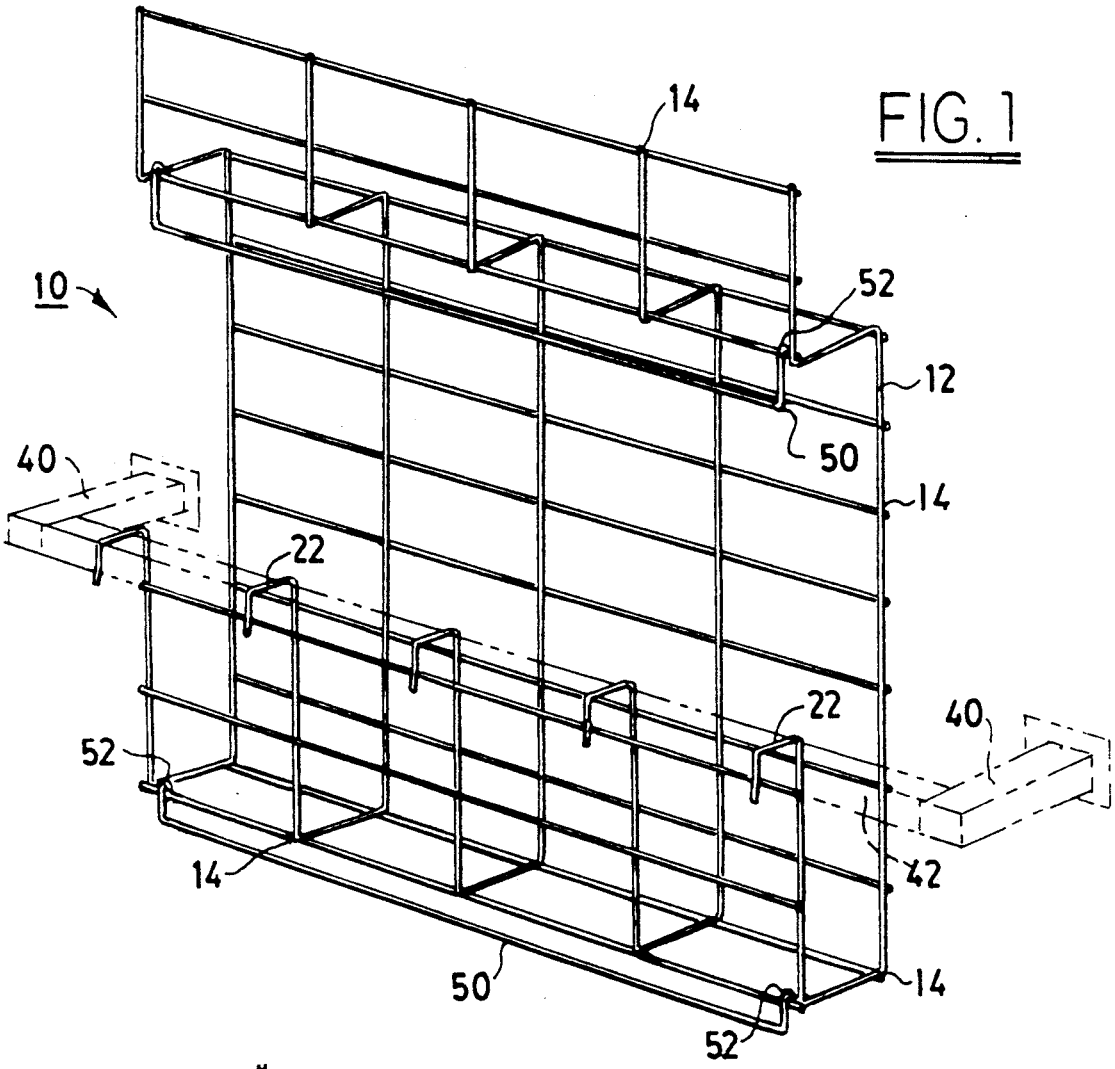
FIG. 1 is a perspective view of the device of the present invention.
Figure 2:
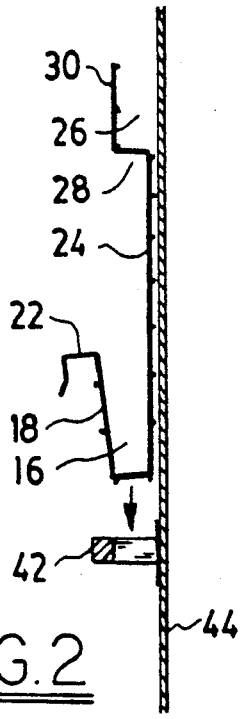
FIG. 2 is a side view of the device of FIG. 1 prior to installation.

The present invention is more clearly illustrated with reference to the drawings where in FIG. 1 a space saver device 10 of the present invention is illustrated in perspective view. The device is in the form of a unitized body, and is constructed of a series of metal wires 12 which are welded together at various contact points 14, and provides at least two storage shelves or baskets 16 and 26. The wire may comprise any suitable metal such as steel or aluminum and preferably has been coated with an outer layer of a suitable plastic material More specifically, the device 10 as shown in the drawings comprises a vertical back leg 24, which when in use, provides support for the device by a cantilever spring effect to be more fully described later. The upper end of leg 24 contains an L-shaped basket 26 which is formed by two right angle bends to form a floor 28 and vertical side wall 30. A lower basket 16 is similarly formed at the bottom end of leg 24 and defined by floor 20 and vertical side wall 18. The top end of side wall 18 is further bent to form a hook 22 which conforms to the cross section of a towel bar. As illustrated in the drawings, the hook 22 is rectangular to conform to the shape of the towel bar being illustrated. As shown in FIG. 2, vertical side wall 18 is formed at an angle greater than 90° with the floor 20 of the lower basket.

Figure 3:
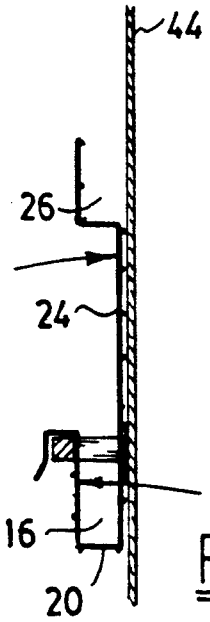
FIG. 3 is a view of the device of FIG. 2 with the device installed on a towel bar fixture.

In use the device 10 is installed by wedging it between the inside of towel bar 42 in adjacent wall 44 as shown in FIGS. 2 and 3 and then snapping the plurality of hooks 22 in place over the towel bar. The towel bar 42 is supported at its ends by a pair of projections 40, which are affixed to wall 44. The fact that side wall 18 is formed at an angle greater than 90° with the floor 20 of the basket results in a cantilever spring effect when loaded, and when he device is wedged between the towel bar and the wall, results in a component force on leg 24 in contact with the wall in the direction of the wall as illustrated by the arrow in FIG. 3. An arrow in a direction opposite wall 44 illustrates a component force that side wall 18 exerts against towel bar 42. As an added optional feature, a single wire 50 with loops 52 at each end spanning the width of the device may be hooked over the bottom rung of one or both of the baskets to provide a towel or washcloth bar, therefore restoring the usefulness or feature of the fixture 42 to which the device 10 is attached.

While the invention has been described in detail with respect to the specific embodiments thereof, it will be understood by those skilled in the art that variations and modifications may be made without departing from the essential features thereof.

What is claimed:

1. A space saving device, suitable for use in conjunction with a towel bar or like fixture, which is in the form of a unitized body constructed of a series of welded wires, said device comprising a plurality of vertical legs adapted to lay against a supporting vertical wall with the upper end of each of said legs having a short horizontal extension with a vertical bend at its end adapted to form an upper basket when said vertical legs are disposed against a flat wall surface, with the lower or opposite end of each of said legs having a short horizontal section with a vertical bend adapted to form at their ends a lower basket when said vertical legs are disposed against a flat wall surface, with said vertical bend of each leg further containing a hook at its end which is adapted to fit over a towel bar.

2. The device of claim 1 where the wire which forms the device contains an outer coating of plastic material.

3. The device of claim 2 in which means for supporting a towel is affixed to the bottom of at least one of said upper and lower baskets.

4. The device of claim 1 in which the outside vertical leg of the lower basket is formed at an angle greater than 90° with the floor of the lower basket in order to create a cantilever spring action when the device is wedged between a towel bar and a supporting back wall.

5. A space saving device which is in the form of a unitized body, said device comprising a plurality of vertical legs adapted to lay against a supporting vertical wall with the upper end of each of said legs having a short horizontal extension with a vertical bend at its end adapted to form an upper basket when said vertical legs are disposed against a flat wall surface, with the lower or opposite end of each of said legs having a short horizontal section with a vertical bend adapted to form at their ends a lower basket when said vertical legs are disposed against a flat wall surface, with said vertical bend of each leg further containing a hook at its end which is adapted to fit over a towel bar.

6. The device of claim 5 in which the body of the device is made of a plastic material.

7. The device of claim 5 in which the body of the device is constructed of wire which is welded together to form the desired shape.

8. The device of claim 5 in which means for supporting a towel is affixed to the bottom of at least one of said upper and lower baskets.

9. The device of claim 5 in which the outside vertical leg of the lower basket is formed at an angle greater than 90° with the floor of the lower basket in order to create a cantilever spring action when the device is wedged between a towel bar and a supporting back wall.

* * * * *